United States Patent [19]

Hale

[11] 4,082,068

[45] Apr. 4, 1978

[54] V-ENGINE COOLING SYSTEM PARTICULARLY FOR OUTBOARD MOTORS AND THE LIKE

[75] Inventor: David Jerry Hale, Pickett, Wis.

[73] Assignee: Brunswick Corporation, Skokie, Ill.

[21] Appl. No.: 610,306

[22] Filed: Sep. 4, 1975

[51] Int. Cl.[2] ..... F01P 7/00; F01P 7/12

[52] U.S. Cl. ..... 123/41.02; 123/41.82 R; 123/41.29

[58] Field of Search ..... 123/41.82, 41.29, 41.08, 123/41.02

[56] References Cited

U.S. PATENT DOCUMENTS

| | | | |
|---|---|---|---|
| 2,334,731 | 11/1943 | Szekely | 123/41.29 |
| 2,713,332 | 7/1955 | Beardsley | 123/41.82 |
| 3,105,472 | 10/1963 | Jasper | 123/41.08 |
| 3,319,614 | 5/1967 | Saanahan | 123/41.29 |
| 3,358,654 | 12/1967 | Shanahan | 123/41.29 |
| 3,921,398 | 11/1975 | Kashmerick | 123/41.08 |

*Primary Examiner*—Charles J. Myhre
*Assistant Examiner*—R. A. Nelli
*Attorney, Agent, or Firm*—Andrus, Sceales, Starke & Sawall

[57] ABSTRACT

An internal combustion engine for an outboard motor includes a cooling passageway extended upwardly through the central core and discharged into a chamber in an exhaust manifold covver between the cylinder banks. The water passes through the cover and to the lateral side edges which have inlets to cooling chambers about the opposite cylinder banks which are continuous and discharge at the uppermost end. The cylinder heads have a cooling chamber with top inlet aligned with the cylinder discharge. The cooling water flows downwardly over to a common discharge header at the lower end for both of the cylinder banks. A pressure relief valve discharges the water from the common header. A separate thermostatic valve is secured to the uppermost end of each of the cylinder banks at the transfer connection from the cylinder cooling chamber to the head cooling chamber and thus at the uppermost and highest point in the two banks. A lower supply chamber is coupled to a pump having a small by-pass opening. The chamber is located at the exhaust pipes and has small ports to spray water into the pipes. Small drains opening from the respective cooling chambers and discharge header drain to the discharge side of the pump for draining of the water from the cooling system through the pump by-pass.

18 Claims, 5 Drawing Figures

47
50'
24
48'
46'
6
8
16
4
30
31
1
49
47
48
50
23
46
12
5
37
9
38
39
7
34
32
35
15
36
39'
13
14
12
34
7
40'
11
10
15
33
42
40
41
29
39
41
41
44
44
51
28
51
53
21
2
52
22
49
26
26
27
20
25
45
19
19a
3

V-ENGINE COOLING SYSTEM PARTICULARLY FOR OUTBOARD MOTORS AND THE LIKE

BACKGROUND OF THE INVENTION

The present invention relates to a cooling system for V-engines and particularly for outboard motors and the like employing high capacity thermostatic and pressure relief controlled systems.

Outboard motors are generally water cooled with the cooling water derived directly from and returned to the body of water through which the motor is operating. A suitable water pump is secured within the lower unit of the outboard motor and connected by an inlet water passageway to a cooling jacket system in the engine and exhaust housing and the like. The pump establishes a relatively high flow of water through the engine, with the output pressure and flow directly related to engine speed to provide the necessary cooling which prevents overheating and damaging of the outboard motor and the engine. However, optimum engine performance is dependent upon providing a more or less controlled cooling of the engine. Thus, generally at idle conditions the engine is preferably operated at significantly higher temperatures than at high speed or wide open throttle conditions to minimize smoking, missfiring, and erratic operation.

Most outboard motors are of a two-cycle construction with the fuel and air intake derived through a pressurized crankcase system. As a result, the heavier fractions of the fuel and oil tend to condense on the inside of the engine parts and cylinders, collecting in any low spots. This phenomenon is well known under the name of puddling and is further known to be the cause of highly erratic idling, with undesirable smoking and missfiring particularly during acceleration. If the engine block is operated at approximately or above 140° F., puddling problems are significantly reduced, because the higher temperature minimizes condensation of the heavier fractions of fuel and oil. Although even higher temperatures might provide some improvement in engine operation, they develop excessively and unacceptable high temperature under the cowl of an outboard motor unit. At wide open throttle, the danger of puddling and misfiring is essentially nil and consequently the engine may operate with high efficiency at low temperatures.

Various cooling systems have been suggested for controlling the temperature and developing a compromise between a relatively high block temperature at idle and relatively low temperature at wide open throttle. On such compromise system employs a pump providing an output directly proportional to speed with a pressure relief valve which establishes a closed cooling system until such time as the pressure reaches a selected minimum value.

The water pump is also normally provided with a small bypass opening to permit complete draining of the system and also minimize the output flow and pressure at low RPM to insure that the pressure relief valve does not open until the desired higher speeds are obtained. At such higher speeds the small bypass opening has essentially no effect on the flow characteristic.

An auxilliary thermostatic valve unit may also be coupled to the system and releases at a selected temperature which will be developed under idle conditions when the pressure is insufficient to open the pressure relief valve and thereby permit cooling flow through the engine. The thermostatic valve thus opens to hold the engine at a maximum idle operating temperature which can be safely employed. The valves have generally been located at a low point in the engine near the discharge of the cooling water. The control valves are normally provided with suitable bypass openings to prevent trapping of air and permit complete filling of the cooling system with water upon starting. This is highly desirable as without some continuous flow localized boiling and steam pockets might develop within the cooling system. The bypass openings also permits draining of the cooling water from the engine upon stopping.

A particularly satisfactory high capacity thermostat-pressure relief controlled system is disclosed in pending U.S. application, Ser. No. 348,661 which was filed on Apr. 6, 1973 and entitled "MARINE ENGINE COOLING SYSTEM EMPLOYING A THERMOSTATIC VALVE AND PRESSURE RELIEF VALVE MEANS."

Although such systems are widely employed in both inline and V-shaped engines, the use of a common pressure release and thermostatic valve for V-shaped engines has not been found to provide optimum cooling characteristics. In V-shaped engines, the cooling water is divided into paralled passageways between the two cylinder banks. The inventor has noted a tendency in such systems to develop areas in one of the banks within which air is trapped and other areas in which water tended to stagnate with local boiling conditions. Although venting systems would appear to be the obvious solution, the inventor has found that in fact the problem remains. Although such systems are employed, they do not provide a desired optimum cooling characteristic.

SUMMARY OF THE PRESENT INVENTION

The present invention is particularly directed to an improved water cooling system of the high capacity thermostat-pressure relief valve type for water cooled V-engines in outboard motors and in particular to eliminate trapped air and stagnant water within the system. The present invention in another aspect and feature provides an improved water cooling passageway system which produces highly efficient cooling of the engine, and may also cool associated components of the outboard motor such as the exhaust housing. Further, the construction is readily adapted to conventional methods of outboard motor production.

Generally in accordance with the present invention, a pair of parallel cooling passageways for the cylinder banks are provided with a pair of thermostatic relief valves mounted one each at an upper portion and preferably at the highest point in the cooling passageway in each of the cylinder banks. The thermostatic valves then function not only to maintain the desired temperature condition at idle but further have been found to function as vent means to positively eliminate the danger of trapping air within the engine cylinder block, with the attendent problems of overheating and stagnated water pockets. In particular, the dual thermostatic valve means maintain continuous and positive flow of cooling water through the engine under all practical operating conditions with the desired optimum cooling of the engine under all operating conditions. The cooling system is completely drained through the use of small drain holes when the engine is not operating.

In accordance with a further novel aspect of a preferred embodiment of the present invention, the cooling system is especially constructed with a cooling chamber adjacent the exhaust tube means for the engine. Such exhaust tube means extend downwardly from the engine through the lower of the outboard motor unit to exhaust the gasses downwardly toward and through the propeller. The cooling chamber is provided adjacent the exhaust tube with small openings to spray cold incoming water into the exhaust tube.

Advantageously a small passageway may also be provided discharging to the exterior of the outboard motor unit and thus providing a continuous visual monitoring and indication of the operation of the pump.

Although any suitable cooling passageway system can be employed, the inventor has found a very practical and reliable cooling passageway system is provided by casting of the inlet passageway into the core of the V-engine block immediately adjacent to the underside of the exhaust passages from each cylinder and the exhaust manifold which is located between the two cylinder banks. The passageway extends upwardly and discharges through the uppermost end of the engine block into an exhaust manifold cover. The cover is formed as a generally hollow member with the cooling water passing through the cover and to the lateral side edges which have inlet passageways to the opposite cylinder banks and particularly the cooling jackets formed about the cylinders. In accordance with this aspect of construction, each bank cooling jacket is a continuous chamber about the several cylinders with a common discharge opening at the uppermost end thereof. The cylinder heads have a cooling jacket coupled to the cylinder water jacket discharge opening with the cooling water flowing downwardly over the head for discharge to a common discharge header at the lower end for both of the cylinder banks. A pressure relief valve discharges the water from the common header overboard or into the drive shaft housing to minimize noise and to further cool the lower exhaust housing. In accordance with the present invention and the optimum construction thereof, a separate thermostatic valve unit is secured to the uppermost end of each of the cylinder banks at the transfer connection from the cylinder cooling jacket to the head cooling jacket and thus a thermostatic valve is located at the uppermost and highest point in each of the two banks. The inlet pump is secured to the lower unit in accordance with the usual construction with a bypass opening and connected to a suitable transfer passageway means formed in the adapter or extension plates located between the lower end of the power head and the drive shaft housing. The lower end of the engine block, the water jacket of each cylinder bank, the exhaust cover and the cylinder heads is provided with a small drain passage connecting to the discharge side of the pump for draining the water from the cooling system through the pump by-pass when the engine is not in operation. The small passageways do not materially affect the cooling water circulation within the engine under operating conditions and in some instances e.g. the exhaust passage divider, provide a more rapid and complete filling of the cooling system upon initial starting of the engine.

The inventor has found that the present invention provides a highly satisfactory and effective cooling system for the engines and particularly has been applied to the V-6 engine for a high powered outboard motor.

BRIEF DESCRIPTION OF DRAWINGS

The drawing furnished herewith illustrates a preferred construction of the present invention in which the above advantages and features are clearly disclosed as well as others that will readily be understood from the following description.

In the drawings.

DESCRIPTION OF THE ILLUSTRATED EMBODIMENT

Figure 1:
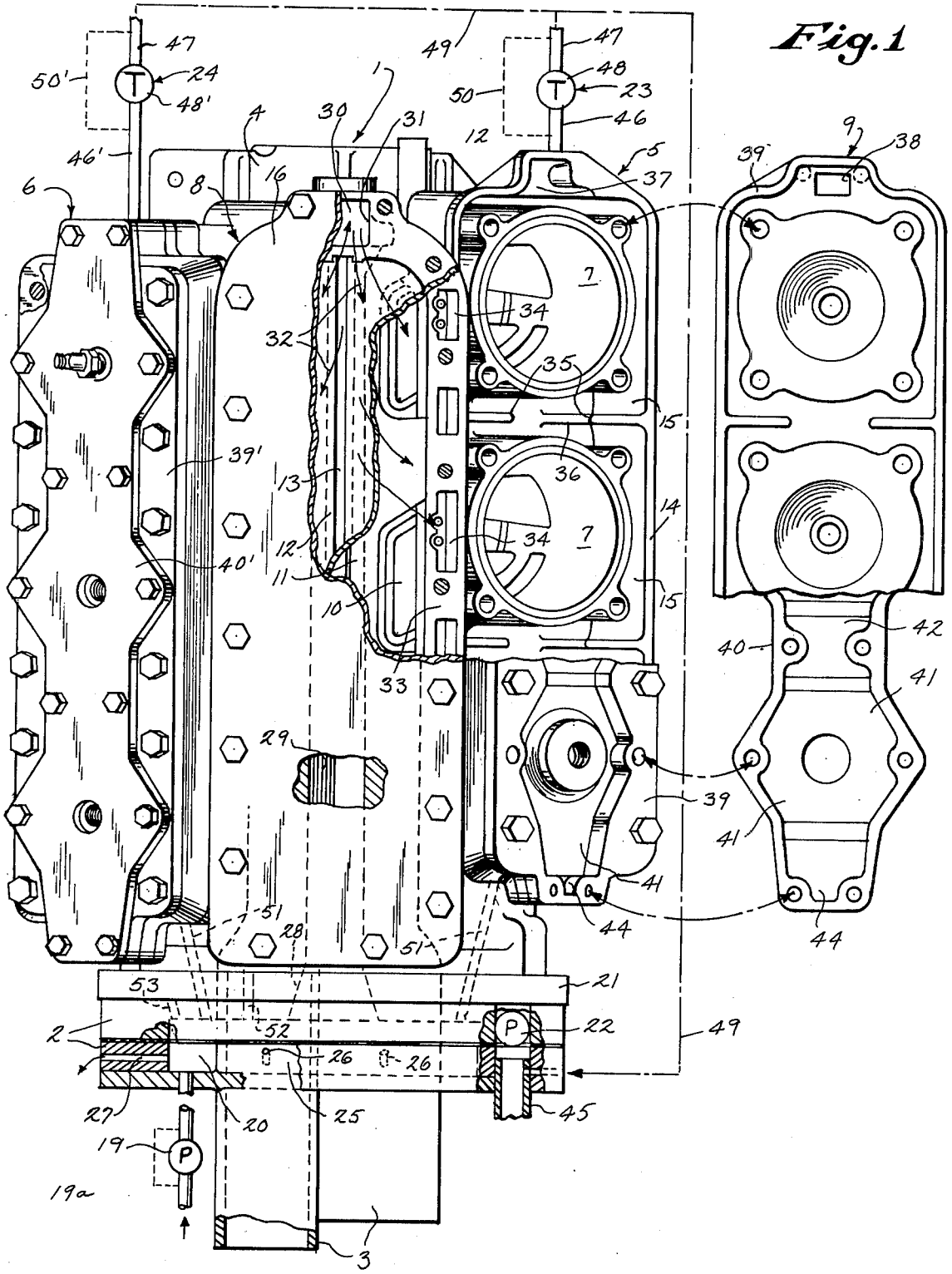
FIG. 1 is a rear elevational view of an internal combustion V-engine for an outboard motor, with parts broken away and sectioned to more clearly show the cooling system.

Referring to the drawings and particularly to FIG. 1, a V-6 engine 1 of a two-cycle variety is illustrated with a pair of lower adapter or extension plates 2 such as generally employed for mounting of the engine upon the upper end of a lower unit (not shown) of an outboard motor unit. An exhaust tube 3, or tubes for a tuned system, is integrally formed with or depends from the adapter plates 2 for exhausting of the exhaust gasses downwardly through the lower unit in accordance with well-known constructions. The illustrated engine 1 is a V-6 engine having an engine block or core 4 with integrally cast cylinder banks 5 and 6, symmetrically formed about a vertical plane through the block 4 with each bank including three cylinders 7. The base or apex portion of the block 4 is cast to define a common crank case within which the usual crankshaft and associated components are connected and the like. The exhaust gasses are discharged to an exhaust manifold 8 which is located between the two banks 5 and 6 of cylinders. In FIG. 1 the right cylinder bank 5 is shown with the head 9 separated to expose the three inline cylinders 7 and illustrate internal detail of construction. Individual exhaust passageways 10 are provided or integrally cast within the block 4 between the cylinder 7 and manifold 8 for discharging of exhaust gases laterally to the center of the block 4 with the gases discharging into the exhaust manifold and particularly a common chamber 11 for the cylinders 7 of bank 5. The exhaust chamber 11 is closed by an exhaust divider plate 12 of a generally T-shaped cross section and having a stem portion 13 extending downwardly into the manifold to divide and form a pair of individual chambers 11 and 11′ for the banks 5 and 6 respectively.

The operation of the engine generates relatively high temperatures and in accordance with accepted practice an engine water cooling system is provided. In the illustrated embodiment of the invention the cylinder block 4 includes an outer wall 14 encircling the cylinder bank 5 and defining a cooling chamber 15 extending downwardly about the three cylinders 7. Similarly, the exhaust manifold 8 includes an outer cover 16 which is secured in overlying relationship to the divider plate 12 to define a cooling chamber 17 therebetween. The stem 13 which divides the exhaust area into chambers 11 and 11′ is hollow and defines an extention 18 of the chamber 17 for more complete cooling of the exhaust passageway.

Cooling water is derived from any well-known pump unit 19 which is in accordance with conventional practice mounted as a part of the outboard motor lower unit, not shown, for raising of water upwardly from the body of water in which the engine is operating. In accordance with the illustrated embodiment of the invention, such water is directed upwardly to header chamber 20 formed in the adapter plates 2 from where it is forced upwardly into and through the engine as presently described.

Generally, the cooling system provides a circulating flow through banks 5 and 6 with discharge to a common discharger header 21 having a pressure relief discharge valve 22. In accordance with the illustrated embodiment, a pair of thermostat valves 23 and 24 are connected over each of the uppermost ends of cylinder banks 5 and 6 and function to produce controlled high temperature operation at idle.

The present invention is particularly directed to the construction of the water cooling system with both thermostatic control and pressure relief means. Consequently no further description of the engine is given other than is required to illustrate and describe a preferred construction of the present invention.

Figure 4:
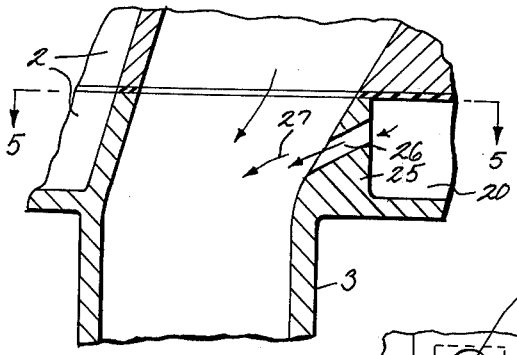
FIGS. 4 and 5 show the inlet water chamber.
Figure 5:
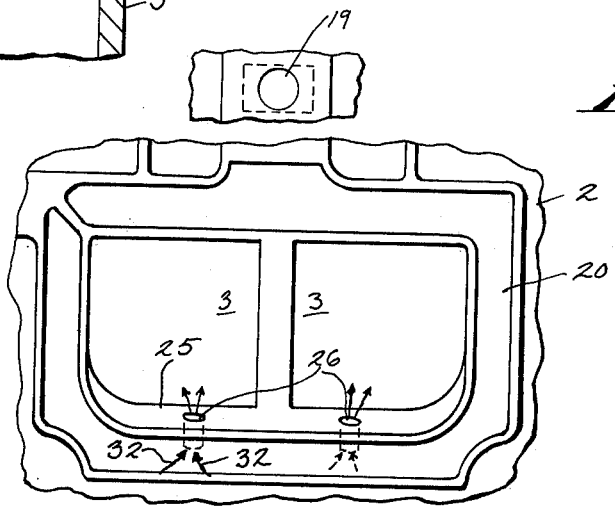

In the illustrated embodiment of the invention, the chamber 20 is shown located immediately about exhaust tubes 3 and having a common wall 25. Small lateral openings 26 are formed in the back wall portion of wall 25, such that under operating conditions a small stream is sprayed into each of the tuned exhaust tubes 3 for cooling of the exhaust gases, as most clearly shown in FIGS. 4 and 5 wherein the usual upper and lower adapter plates 2 are shown with the exhaust pipe 3 integrally formed in the lower adaper plate and the upper plate forming an extension of the exhaust pipes and having a water inlet to the cooling passage. A small tell-tale opening 27 may be provided in the base portion of the U-shaped chamber 21 and directed outwardly to the exterior of the outboard motor unit to provide a small continuous stream of water whenever the water pump is operating. This will thus provide a continuous indication of the operating conditions of the cooling system.

The chamber 21 and interconnections thereof are diagrammatically illustrated. The lower extension or adapter plates 2 are generally cast elements and may be formed with any suitable integral passageways and compartments in or at the mating surfaces. Thus in actual practice the water may be introduced into the lower extension plate, channeled rearwardly through the upper extension plate and directed into a compartment formed in the lower plate with a small dam construction leading to the spray discharge passageways. A main discharge passageway 28 extends upwardly through the upper extension plate 2 for coupling to the lower end of the engine block 4 with the greater portion of the pumped water directed into the engine block 4 and passed to the cooling chambers 15, 17, and 18 as follows.

Figure 2:
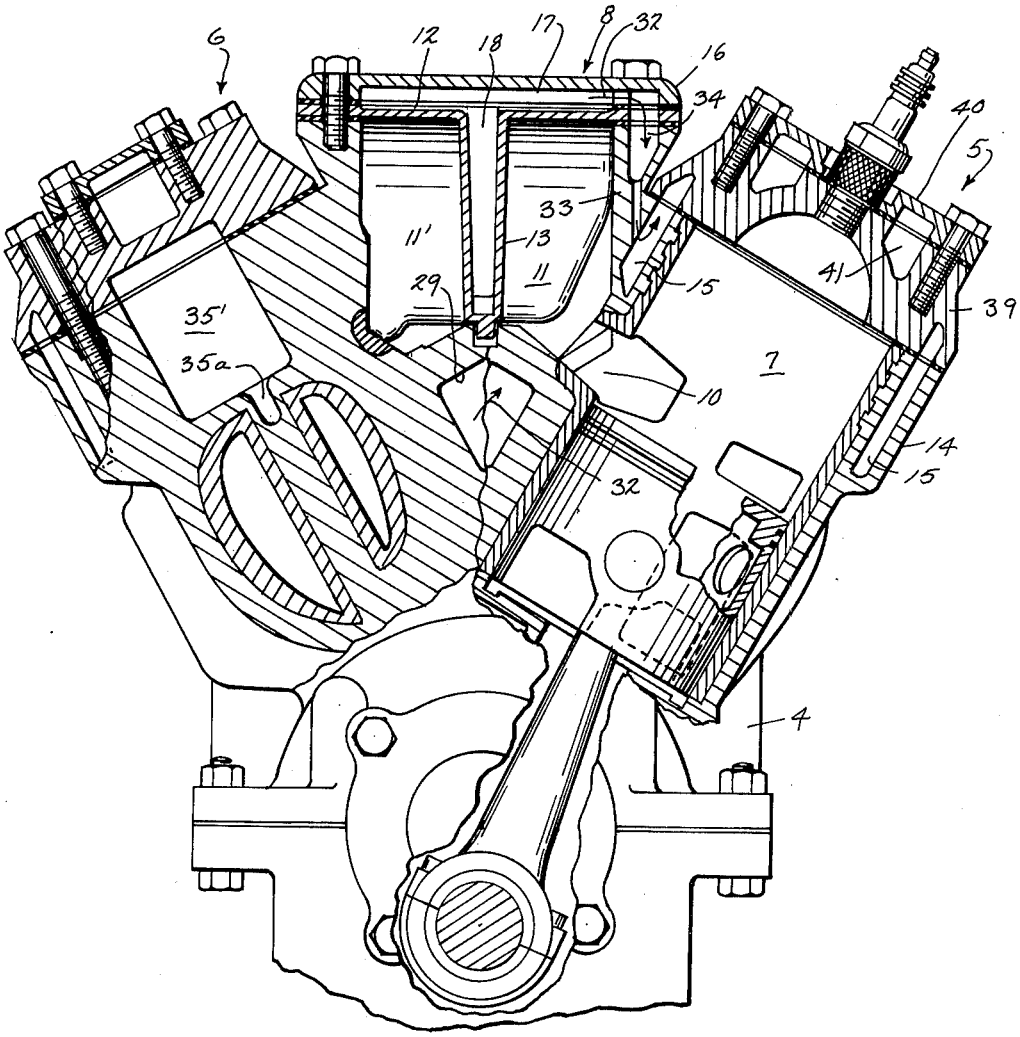
FIG. 2 is a fragmentary horizontal section taken generally on line 2—2 of FIG. 1.

In accordance with a preferred construction as shown in the drawing, the engine block 4 includes a vertically extending central passageway 29 in the core portion of the V-shaped block 4. The passageway 29 is a generally triangular shaped passageway having a lower end aligned with passageway 28 and extending upwardly in closely spaced relation to the exhaust chamber 11 and 11', as most clearly shown in FIG. 2. This construction channels the coolest water to the core of the engine and particularly to the bottom side of the exhaust passages 10. The engine block 4 is of course tightly clamped to the upper adapter plate 2 with a suitable sealing gasket therebetween such that the passage 29 in essence forms a continuous extension of the inlet passageway 28 in the upper extension plate 2. The cooling water thus passes upwardly to the uppermost end of the engine block 4 and passes into the exhaust divider plate cooling chamber 18 at the upper end through an aft directed passageway or opening 30. The divider plate 12 and the recessed outer exhaust cover 16 extend over the opening 30. The divider plate 12 includes an opening 31 aligned with opening 30, and the recess of the cover 16 extends in overlying relationship to said aligned openings 30, 31 such that the cooling water 32 flows upwardly through the core passageway 29, through the openings 30 and 31 and into the cooling chamber 17 and 18 defined by the exhaust cover 16 and divider 12. The water 32 is directed and flows from chamber 17 in the exhaust manifold divider 8 to the cylinder banks 5 and 6, as follows. The encircling cylinder jacket wall 14 includes an inner wall 33 forming a common dividing wall between the exhaust chamber 11 and the cylinders 7. The wall 33 includes individual openings 34 laterally aligned with each of the cylinders 7 and providing interconnection from the exhaust cooling water passageway 17 to the cylinder cooling chambers 15. Thus the water 32 from the top openings 30 will flow downwardly through the exhaust cover chambers 17 and 18, then laterally through the openings 34 for introduction directly into the chamber 15 surrounding each of the cylinders 7. The chamber 15 encircles each of the cylinders 7. Intermediate lateral walls 35 add integral strength to the engine block and partially separate the chamber 15 between the cylinders 7. Openings 36 through the walls 35 are provided such that a single or continous water chamber 15 is formed. In operation, the cooling water 32 will flow through the openings 34 from the exhaust divider chamber 17 into the respective cylinder portions of chamber 15 in each bank of cylinders 5 and 6, and discharge through a passage 37 integrally formed in the uppermost end of each cylinder bank. The passages 37 open laterally for directing the water into an aligned opening 38 in each cylinder head 9, at which connection or junction a thermostat valve 23 is connected into the cooling system.

The illustrated cylinder head 9 is a two-piece assembly and includes an inner closure plate 39 which abutts the block 4 and defines the cylinder head for proper shaping of the cylinder chamber and is provided with a threaded spark plug opening. An outer head cover 40 is bolted overlying the cylinder head plate 39 and is, together with the top surface of plate 39, recessed and shaped to define a closed cooling passageway 41 extending from the upper lateral water inlet passageway 38 downwardly over and around each of the cylinder heads to affect continuous cooling of the head. The passageway 41 is formed to maximize the flow of the cooling water over the shaped head portions and has relatively narrowed portions 42 between the cylinders 7. The cooling water is discharged at the lowermost end of the cylinder head cooling chamber 41 through a suitable passageway 44 formed in the wall 14 and leading to the discharge header 21.

The opening 44 discharges into the common header or chamber 21 which is preferably formed in the upper exhaust adapter plate 2. The cylinder bank 6 is formed with a cooling jacket system which parallels that just described between the upper end of the manifold 8 and the common header 21. A common water outlet 45 extends from the header 21 for discharging the water. Generally, such water would be passed through an exhaust cooling water jacket or the like in the lower housing, not shown, as well known to the art. The outlet 45 includes the pressure relief valve 22 which may be of any suitable construction and is conventionally a suitable spring loaded valve set up to open at a selected pressure in the header 21. A particularly satisfactory valve construction is more fully disclosed and shown in the previously identified copending U.S. application for patent. The pressure relief valve 22 is set to hold the cooling passageways closed until the engine speed reaches a selected level, at which time the pressure of the pump 19 will be sufficient to overcome the pressure relief valve and establish the high rate discharge from the header 21. This in turn will establish a relatively high rate of cooling flow through the engine to operat eht engine at a relatively low temperature.

Further, as previously noted, the cooling system is a thermostat-pressure relief type and in the illustrated embodiment of the invention the pair of individual thermostats 23 and 24 are provided to separately and selectively open the parallel cooling passageway paths when each cylinder head temperature reaches a selected level. As in the prior art the thermostatic valves 23 and 24 primarily operate under low speed or idle conditions to establish a flow from the engine to prevent the temperature from rising above a damaging level before the pressure is sufficient to open the pressure relief valve 21. The thermostat valves 23 and 24 are connected to the upper portion of the cooling system as illustrated in the preferred embodiment are preferably connected to the very highest point in each of the individual cooling passageways of the two cylinder banks 5 and 6.

Each of the thermostatic units 23 and 24 is generally similarly constructed and only unit 23 is specifically described.

Figure 3:
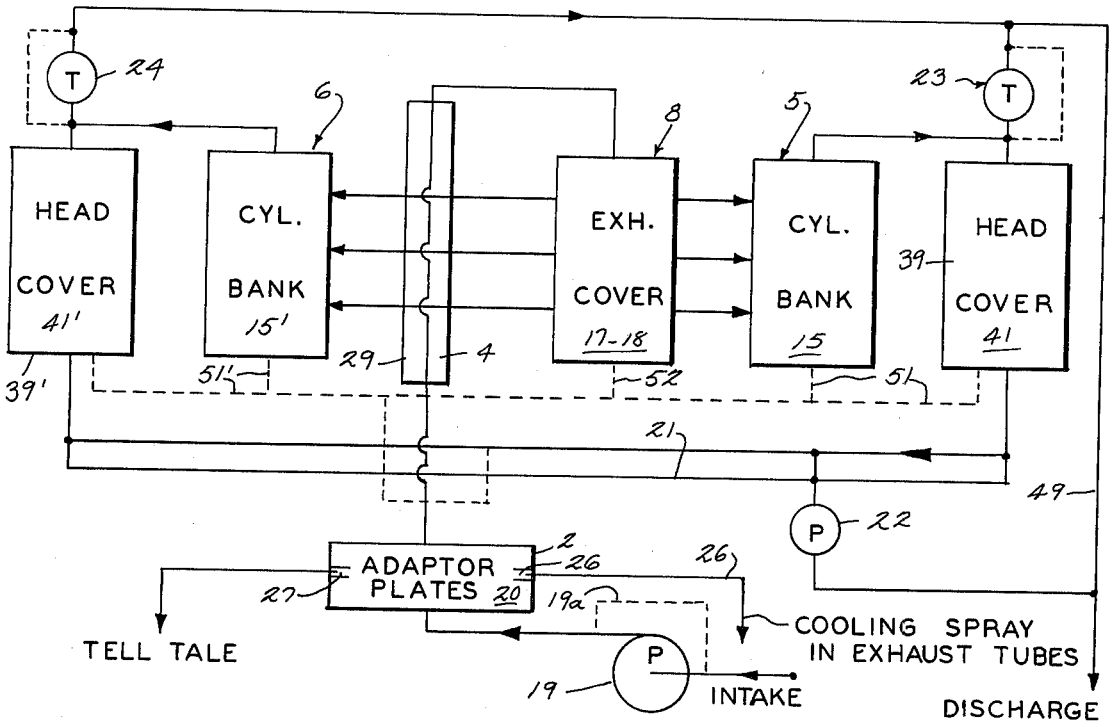
FIG. 3 is a simplified schematic illustration.

The valve 23 is coupled to the engine so as to respond to the water temperature and may be constructed as in the above identified application. It is therefore diagrammatically illustrated including an inlet hose 46 connected to the engine block at the transfer passageway or opening 37 at the upper most point in the cooling system for its bank of cylinders. An outlet hose 47 leading from the thermostatic valve 23, as diagrammatically illustrated in FIG. 3, is coupled to the discharge side of the pressure relief valve 22 for discharge overboard and where employed through the exhaust water jacket. A temperature responsive element 48 provides for opening and closing of the valve. The element 48 is set to open at a selected temperature, for example, 140° F., and allows the water to discharge through outlet 47, thereby establishing flow through the inlet passageway 29, the exhaust manifold cover chamber 17–18 and its companion cylinder chamber 15. The valve 24 will be similarly constructed with its discharge tube 46' similarly interconnected to the discharge side of the pressure relief valve 22. A common connecting tube 49 may of course be employed, as diagrammatically illustrated in FIG. 3.

The Inventor has found that by limiting the flow of water through the cylinder head cooling jacket 41 and providing thermostatically limited flow of cooling water to the cylinder water jacket 15, the system produces highly effective and efficient cooling under idle and low speed conditions. The inventor has thus discovered that in fact it is not desirable in all cases to maintain the thermostatic valve adjacent to the pressure relief valve in accordance with the more or less conventional practice, and that the positioning of thermostatic valves in accordance with the teaching herein provides improved and effective cooling of a V-type outboard engine.

The valve 23 also includes a small by-pass opening 50, as diagrammatically illustrated by a dotted line, which provides continuous venting of the cooling system. The by-pass openings in the thermostatic valve 23 does not affect the cooling operation but provides a highly effective venting system when applied to the uppermost end of the engine cylinder bank 5 to ensure complete filling of the system with the complete elimination of steam or air pockets and stagnate water within the block.

When the engine operation terminates, it is desirable to completely drain the engine. In the illustrated embodiment of the invention small drain lines are provided from the respective chambers for draining all cooling water back to the common header chamber 20, as follows.

The cylinder cooling jackets or chambers 15 and 15' are connected by separate small drain holes 51 and 51' in the lower end of the block 4 and aligned openings in the adapter plates 2 to drain directly to the chamber 20. A similar opening 52 is formed in the block 4 in communication with the exhaust cooling chambers 17–18 between plate 12 and the cover 16. Finally, the discharge header 21 is provided with a similar passageway 53 integrally cast in the adapter plates 2 such that all coolant trapped in the cooling chambers will drain directly into the header 20 from which the coolant discharges downwardly through bypass opening **19*a* of the pump and/or through the drain holes 25 and 26 from the compartment to the exhaust tube 3. The connection of the several channels to the common header or chamber 20** not only effectively drains the several cavities or chambers but also contributes to rapid filling of the several chambers upon initial starting of the engine. It should be noted that all of such drain holes however, are of a sufficiently small size in accordanc with well known practice that they do not appreciably affect the cooling system under operating conditions.

In summary, as shown in FIG. 1 and in the simplified illustration of FIG. 3, when the engine is idling, the cooling water flows through chamber 20 with slight streams discharging from ports 25–27 and with the greater flow into and through the inlet passageway 29, chambers 17 and 18, dividing into the cylinder chambers 15 and 15', and discharging into the cylinder head chambers 41 and 41' to completely fill such chambers. The several drain openings 51–53 will also carry water into the respective chambers. Initial engine operation, rapidly increases the engine temperature and that of the water 32; when the temperature reaches 140° F., valves 23 and 24 open and the flow through the system and particularly including the cylinder chambers 15 and 15' is created. Slight flow from the head chambers 41 and 41' may also occur as a result of the drain openings. This invention insures the complete filling of the cooling system without air pockets and/or stagnant water while maintaining the temperature at the desired elevated but safe operating level.

As the engine speed increases, the pump pressure output increases and increases the flow rate with increased cooling. At a selected speed, the pressure rises to the level of the pressure relief valve 22, which opens and establishes full flow through the system with significant temperature reduction for cooling, high speed operation.

Various modes of carrying out the invention are contemplated as being within the scope of the following claims, particularly pointing out and distinctly claiming the subject matter which is regarded as the invention.

I claim:

1. In an outboard motor having an engine with a pair of vertically arranged cylinder banks with a pair of parallel cooling water chambers between a common water inlet passageway means at the lower end of the cylinder banks and a common water discharge passageway means at the lower end of the cylinder banks providing a cooling flow upwardly and then downwardly to the discharge passageway means, pressure relief valve means in said discharge passageway means and selected to hold the discharge passageway means closed below a predetermined engine speed, and a pair of thermostatic valve means connected one each to the upper portion of each of said water cooling chambers to separately control water exit from the upper end portion of said chambers at idle.

2. In the outboard motor of claim 1 wherein said engine includes an exhaust gas chamber means and said common water inlet passageway means includes an exhaust chamber divider and cooling member.

3. The motor of claim 2 wherein said engine includes a V-shaped block having an inner core, said common water inlet passageway means including an inlet water cooling passageway integrally formed in said core with a bottom inlet opening and a top outlet opening, said exhaust cooling chamber divider and cooling member including an exhaust cover having a top inlet opening aligned with the top outlet opening of said inlet water cooling passageway.

4. In the outboard motor of claim 3 including a lower unit having a pump means and an exhaust tube means extending downwardly from the engine through the lower unit, said pump means having a coupling passageway means being connected to the bottom inlet opening at the lower end of the engine, and small bleed ports coupled to the coupling passageway means and directed into the exhaust tube means.

5. The outboard motor of claim 4 including drain openings from the cylinder banks to said coupling passageway means to completely drain the cooling system upon engine shut-down and rapid filling of the cooling passageway means on engine start-up.

6. In the outboard motor of claim 2 wherein said exhaust chamber means is located between said cylinder banks, and said exhaust divider and cooling member have a generally T-shaped cross-section with a stem portion centrally aligned between the cylinder banks to define separate exhaust manifolds.

7. In the outboard motor of claim 3 having cylinder heads secured to the cylinder banks with said heads having cooling chambers having a top inlet aligned with the cylinder bank cooling chambers and having a bottom discharge outlet connected to said common discharge passageway means.

8. In an outboard motor having a pair of angularly oriented cylinder banks in a V-shaped block with removable cylinder heads, said engine being supported on a lower support means with the pair of cylinder banks vertically oriented, the improvement in a cooling system for said engine comprising a pair of parallel passageway means extending one each about said cylinder banks and said cylinder heads and passing upwardly from a bottom inlet means and then downwardly through the individual parallel cylinder banks to a common discharge means at the lower end of the cylinder banks, said discharge means having means to hold the discharge means closed until said engine reaches a selected speed, and thermostatic valve means coupled to the upper portion of each of said passageway means and operable to open and discharge coolant from the upper ends of the passagway means at a selected temperature.

9. The motor of claim 8 wherein said thermostatic valve means includes individual valves for each cylinder bank to separately control discharge from each of said passageway means.

10. The motor of claim 9 wherein said cylinder banks have exhaust gas outlets to an exhaust chamber between said cylinder banks and having an exhaust cover, said exhaust cover including a cooling chamber having an inlet opening connected to the incoming coolant with the side portions of said exhaust cover having discharge openings aligned one with each cylinder, said cylinder banks each having an outer jacket wall defining a cooling jacket extended throughout the cylinder bank, said jacket wall including an inner portion abutting said side portions of the exhaust cover and having jacket inlet openings aligned with said exhaust cover discharge openings and a jacket discharge opening in the uppermost portion of the cooling jacket, said heads having head inlet openings aligned with the jacket discharge openings and having a head cooling chamber overlying the cylinders, said thermostatic valve means being connected to the cylinder banks at the aligned openings in said cylinder and head jackets, said heads having a lower discharge passageway means to discharge the coolant to said common discharge means.

11. In the outboard motor of claim 8 wherein said lower support means includes a water inlet source and a depending exhaust pipe means, and having a coolant inlet chamber in said support means connected to said water inlet source, and discharge means establishing at least one water cooling jet into said exhaust pipe means.

12. In the outboard motor of claim 11 wherein said lower support means includes a small tell-tale opening to said inlet chamber to establish a small visual jet overboard during flow of water through said coolant inlet chamber.

13. In the outboard motor of claim 11 wherein said cylinder banks, cylinder heads and exhaust cover have individual drain openings connected to said inlet coolant chamber.

14. In an outboard motor having a V-engine core with angularly oriented multiple cylinder banks projecting therefrom, each bank including a plurality of in-line vertically oriented cylinders having removable cylinder heads and having exhaust outlets to an exhaust chamber between said cylinder banks, said cylinder heads and banks and said exhaust chamber having individual cooling jackets, and having a speed responsive coolant source means, the improvement in a cooling system having an inlet connected to said source means for cooling said engine and comprising an inlet passageway means extending through the core centrally of the cylinder banks and terminating at the upper end in a rearwardly directed core discharge opening, said exhaust cover including an exhaust coolant inlet opening aligned with said core discharge opening to direct the water downwardly through the exhaust cover, the side portions of said exhaust cover having discharge openings aligned with inlet openings to each of the cylinder coolant jackets, said cylinder coolant jackets having discharge openings in the uppermost portion of the cooling jacket aligned with head coolant inlet openings to define a common chamber means in the upper portions of the cooling jackets, means connected to the bottom of both said head cooling jackets to discharge the coolant, a pressure relief valve means in said discharge means, said valve means being normally closed and selected to hold the passageway means closed below a predetermined engine speed, and having a pair of thermostatic valve means connected one each to said common chamber means to exit water at low engine speed operation.

15. In an outboard motor having an internal combustion engine having an internal cooling passageway means having an inlet for introducing coolant into said passageway means for cooling said engine, said passageway means having an upper end and extending downwardly through the engine to a bottom discharge means for discharge of said coolant, a pressure responsive discharge valve in said bottom discharge means, a temperature valve responsive to the temperature of the engine to open with said discharge valve closed, and means mounting said temperature valve in the upper end of said coolant passageway means for discharge of coolant with the pressure responsive discharge valve closed.

16. In the outboard motor of claim 15 wherein said temperature valve is located at the highest area in said passageway means.

17. In a V-engine, cylinder banks integrally cast with a central cylinder core and exhaust ports exhausting laterally toward each other to a common exhaust manifold means during an outer cover with an internal exhaust cooling chamber, a coolant inlet passageway means including a first passageway extending upwardly through the cylinder core adjacent the manifold means and discharging at the upper end into said exhaust cooling chamber, each of said banks having a cooling jacket coupled to said exhaust cooling chamber, said cooling jacket having a top discharge opening, said cylinder banks each including an outer cylinder head having a cooling chamber having a top inlet opening coupled to said top discharge opening, a bottom discharge header coupled to the bottom end of each of the cooling chambers in said heads, pressure relief valve means in said header to discharge cooling water overboard, and a pair of thermostatic relief valves connected one each at the top discharge opening of each cylinder bank for discharging of cooling water from the upper end of said cooling jacket with said pressure relief valve means closed.

18. In the engine of claim 17 wherein a lower inlet supply chamber is coupled to said inlet passageway means, and all of said chambers having drain holes means to drain into said inlet supply chamber.

* * * * *